US009635448B2

(12) United States Patent
Monahan et al.

(10) Patent No.: US 9,635,448 B2
(45) Date of Patent: Apr. 25, 2017

(54) T-SHAPED JOINT IN A HEADPHONE CORD

(71) Applicant: Bose Corporation, Framingham, MA (US)

(72) Inventors: Michael Monahan, Southborough, MA (US); Andrew D. Dominijanni, Newton, MA (US); Kyle DeCubellis, South Boston, MA (US)

(73) Assignee: Bose Corporation, Framingham, MA (US)

( * ) Notice: Subject to any disclaimer, the term of this patent is extended or adjusted under 35 U.S.C. 154(b) by 188 days.

(21) Appl. No.: 14/541,793

(22) Filed: Nov. 14, 2014

(65) Prior Publication Data

US 2016/0142808 A1 May 19, 2016

(51) Int. Cl.

| | |
|---|---|
| ***H04R 25/00*** | (2006.01) |
| ***H04R 1/10*** | (2006.01) |
| ***H04R 5/033*** | (2006.01) |

(52) U.S. Cl.

CPC ..... *H04R 1/1033* (2013.01); *H04R 1/105* (2013.01); *H04R 1/1016* (2013.01); *H04R 5/033* (2013.01); *H04R 2201/105* (2013.01); *H04R 2499/11* (2013.01)

(58) Field of Classification Search

CPC ..... H04R 1/10; H04R 1/1016; H04R 1/1033; H04R 5/033; H04R 2201/105; H04R 2201/107; H04R 2499/11; H04M 1/15

USPC ..... 381/309, 74, 370, 376, 380, 384; 379/430, 438; 181/129, 130, 135; 455/575.1, 575.2, 575.6; 242/378, 378.1, 242/378.2

See application file for complete search history.

(56) References Cited

U.S. PATENT DOCUMENTS

| | | | | |
|---|---|---|---|---|
| 2,641,327 A * | 6/1953 | Balmer | H04R 1/105 181/129 |
| 6,834,820 B2 * | 12/2004 | Wei | B65H 75/4449 191/12.2 R |
| 9,167,330 B1 * | 10/2015 | Shattuck | H04R 1/1033 |

* cited by examiner

*Primary Examiner* — Huyen D Le

(57) ABSTRACT

An apparatus includes first and second electroacoustic output transducers, first and second cables each including conductors electrically coupled to inputs of the corresponding first and second electroacoustic output transducers, a third cable including conductors, and a joint housing. The conductors of the third cable are electrically coupled to corresponding conductors of the first and second cables inside the joint housing. Each of the first, second, and third cables is physically retained to the joint housing. The first and second cables exit the joint housing at a distance of at least 10 mm apart from each other.

16 Claims, 7 Drawing Sheets

T-SHAPED JOINT IN A HEADPHONE CORD

BACKGROUND

This disclosure relates to audio headphone cords, and in particular, cords having a T-shaped joint.

Headphones for listening to stereo or binaural audio sources commonly connect to the audio sources using cords in one of two configurations. In some examples, a single electrical cable supplies both left and right signals to one ear cup, and another cable connected between the ear cups, such as through the headband, brings the appropriate signal to the opposite ear cup. In other examples, the single cable splits at some point, and separate cables go to each ear cup, each carrying signals for only one of the ears. The point at which the cable splits is commonly shaped like a capital letter Y, where the upper cables are approximately parallel to the direction of the lower cable, and is commonly called the Y-joint. We use "cord" to refer to the overall assembly of cables and connections, and "cable" to refer to the individual bundles of conductors making up the cord. A cable may be a single jacket surrounding several conductors, or it may be a bundle of individual conductors attached together, such as by bonding or twisting, to form a cable without a common jacket.

SUMMARY

In general, in one aspect, an apparatus includes first and second electroacoustic output transducers, first and second cables each including conductors electrically coupled to inputs of the corresponding first and second electroacoustic output transducers, a third cable including conductors, and a joint housing. The conductors of the third cable are electrically coupled to corresponding conductors of the first and second cables inside the joint housing. Each of the first, second, and third cables is physically retained to the joint housing. The first and second cables exit the joint housing at a distance of at least 10 mm apart from each other.

Implementations may include one or more of the following, in any combination. The third cable may exit the joint housing in a first direction, and the first and second cables may exit the joint housing in second and third directions opposite to each other, each perpendicular to the direction of the third cable. First and second strain reliefs may surround the respective first and second cables where the cables enter the joint housing. The first and second cables may exit the joint housing in first and second directions opposite to each other, and the first and second strain reliefs may maintain the first and second cables in the respective first and second directions for a distance of at least 5 mm from a centerline of the joint housing. The first and second strain reliefs may mechanically retain the first and second cables to the joint housing. The joint housing may include an inner assembly within which the conductors of the first, second, and third cables are electrically coupled, and an over-mold may cover at least the portions of the inner assembly where the first, second, and third cables exit the joint housing, the over-mold extending away from the inner assembly to also form strain reliefs around each of the first, second, and third cables.

The joint housing may include an outer cover covering portions of the inner assembly other than where the first, second, and third cables exit the joint housing. The over-mold may cover the entirely of the inner assembly, and the outer cover may cover a portion of the over-mold. The over-mold may not cover portions of the inner assembly covered by the outer cover. The joint housing may include an inner shell within which the conductors of the first, second, and third cables are electrically coupled, and to which the cables are retained, having an open portion through which the conductors may be accessed, and an outer cover may covering the open portion of the inner shell. The first, second, and third cables may be retained in the inner shell by first, second, and third plugs affixed to ends of outer jackets of the respective cables, the plugs being larger than openings in the inner shell through which the cables pass.

The third cable further may include additional conductors electrically coupled to components within the joint housing. A printed circuit board may be included, the conductors of the first, second, and third cables each electrically coupled to the printed circuit board, and electrically connected to each other by circuitry within the printed circuit board. The third cable may further include additional conductors electrically coupled to the printed circuit board, the joint housing further including additional components coupled to the additional conductors of the third cable via the printed circuit board. The additional components may include a microphone array. The additional components may include buttons.

In general, in one aspect, an apparatus includes a connector having electrical contacts for receiving two electrical signals, first and second electroacoustic output transducers, first and second cables each including conductors electrically coupled to inputs of the corresponding first and second electroacoustic output transducers, a third cable including conductors electrically coupled to the contacts in the connector, and a joint housing. The conductors of the third cable are electrically coupled to corresponding conductors of the first and second cables inside the joint housing. Each of the first, second, and third cables are physically retained to the joint housing. The third cable exits the joint housing in a first direction, and the first and second cables exit the joint housing in second and third directions opposite to each other, each perpendicular to the direction of the third cable.

In general, in one aspect, an apparatus includes first and second electroacoustic output transducers, first and second cables each including conductors electrically coupled to inputs of the corresponding first and second electroacoustic output transducers, and a cable management slider having first and second channels surrounding the first and second cables, respectively, and through which the first and second cables can slide. The first and second cables exit the cable management slider at a distance of at least 10 mm apart from each other. The first and second channels may be arranged such that the first and second cables enter the cable management slider in a first common direction, and the first and second cables exit the cable management slider in second and third directions opposite to each other, each perpendicular to the first common direction.

Advantages include improved motion of the headphone cable on the head, reduced audible cable vibrations, and improved positioning of microphone or user interface elements on the joint housing.

All examples and features mentioned above can be combined in any technically possible way. Other features and advantages will be apparent from the description and the claims.

DESCRIPTION

Figure 1:
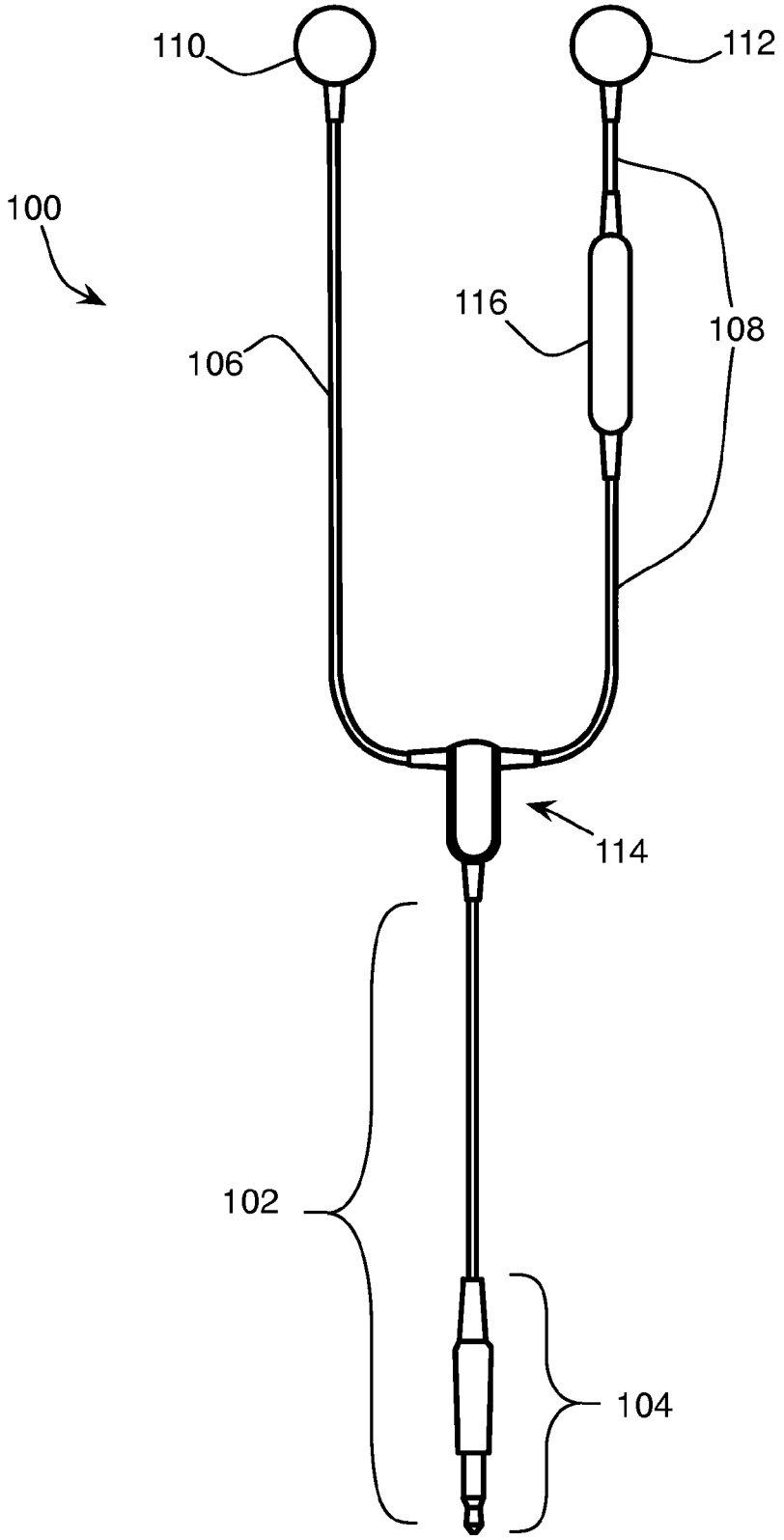
FIG. 1 shows a set of headphones having a T-joint in the cord.

A T-shaped joint, or T-joint, as shown in FIG. 1, provides numerous advantages over the conventional Y-shaped joint in a stereo headphone cord. A headphone assembly 100 incorporating such a T-joint includes a lower cable 102, which has a plug 104 for connection to an audio source, and two upper cables 106, 108, ending in earbuds 110, 112 or other headphone structures for delivering sound to the user. These three cables are joined in a T-joint 114, which holds the upper cables at a 90° angle to the lower cable, 180° apart from each other, for a certain minimum distance. An optional user interface module 116, including one or more microphones and buttons, may be located on one of the upper cables, on the lower cable, or integrated into the T-joint.

When the user's head moves, the motion of the T-joint is smoother than that of a comparable Y-joint. The entire upper section of the headphones, including the joint, upper cables and earbuds, and the user's head, behaves as a four-bar linkage that swings with the geometric distorting of a quadrilateral. In some examples, it is preferred that the T-joint maintain the upper cables for a distance of at least 3 mm from the centerline of the T-joint, and preferably more, such that the cables cannot turn towards the head until they are 6 mm or more apart. In some cases, a total separation of 10 mm or more is desirable. In contrast, a Y-joint configures the upper section of the headphones essentially as a triangle (the initial distance between the upper two cables being small), which results in the Y-joint swinging less smoothly when the head moves, particularly in reaction side-to-side rotation. In addition to being more comfortable, the smoother motion of the T-joint reduces audible cable vibrations—the audible sound of cable vibration mechanically transmitted through the earbuds into the user's ear. The smooth swinging of the T-joint mitigates the tensile impulses that result from the swinging of the assembly, whereas with a Y-joint each upper cable section is alternately loaded and unloaded by the swinging mass of the Y-joint and the cable below it. The T-joint also prescribes a cable route that is farther from the user's face, neck, and clothing than a Y-joint. Those surfaces are major sources of audible cable vibrations, from tapping and rubbing of the cable, so reducing contact with body and clothing is a further improvement.

The T-joint also orients itself on the user's chest more easily. In the case where a microphone is located in the T-joint, this is particularly advantageous, as the orientation of the microphone relative to the user's mouth can be controlled to great advantage in its performance. It also keeps any buttons on the joint in their expected locations. In Y-joints, the two upper cables often twist around each other, rotating the Y-joint and moving any microphone in it out of alignment and buttons out of position. The horizontally-opposed cable exits or cable exit spacing of the T-joint prevent this.

Figure 2:
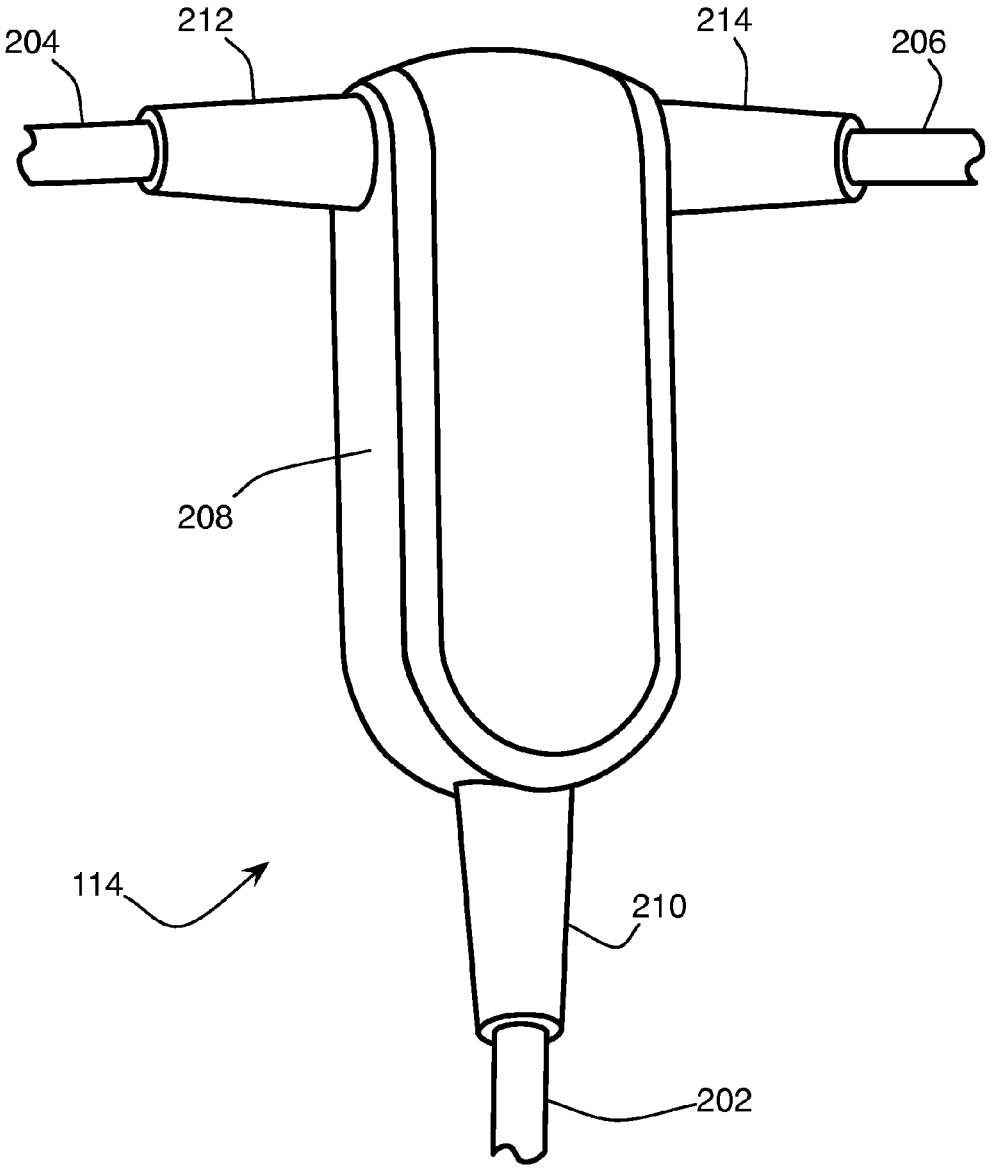
FIG. 2 shows a perspective view of the T-joint of FIG. 1.

Providing a T-shaped joint in a headphone cord is not a simple matter of reorienting two of the three cables in a conventional Y-joint. Forcing the cables to make a 90° turn, and to exit the joint at 180° opposition, requires additional mechanical structures. FIG. 2 shows the general construction of the T-joint 114. Lower cable 202 enters the joint 200 from below, and right and left upper cables 204, 206 exit the joint on opposite sides at the top. The cables are electrically joined inside the joint body 208 as described below. Strain reliefs 210, 212, and 214 prevent the cables from bending too-sharply where they exit the joint body, helping to maintain the T-shaped orientation.

Figure 3:
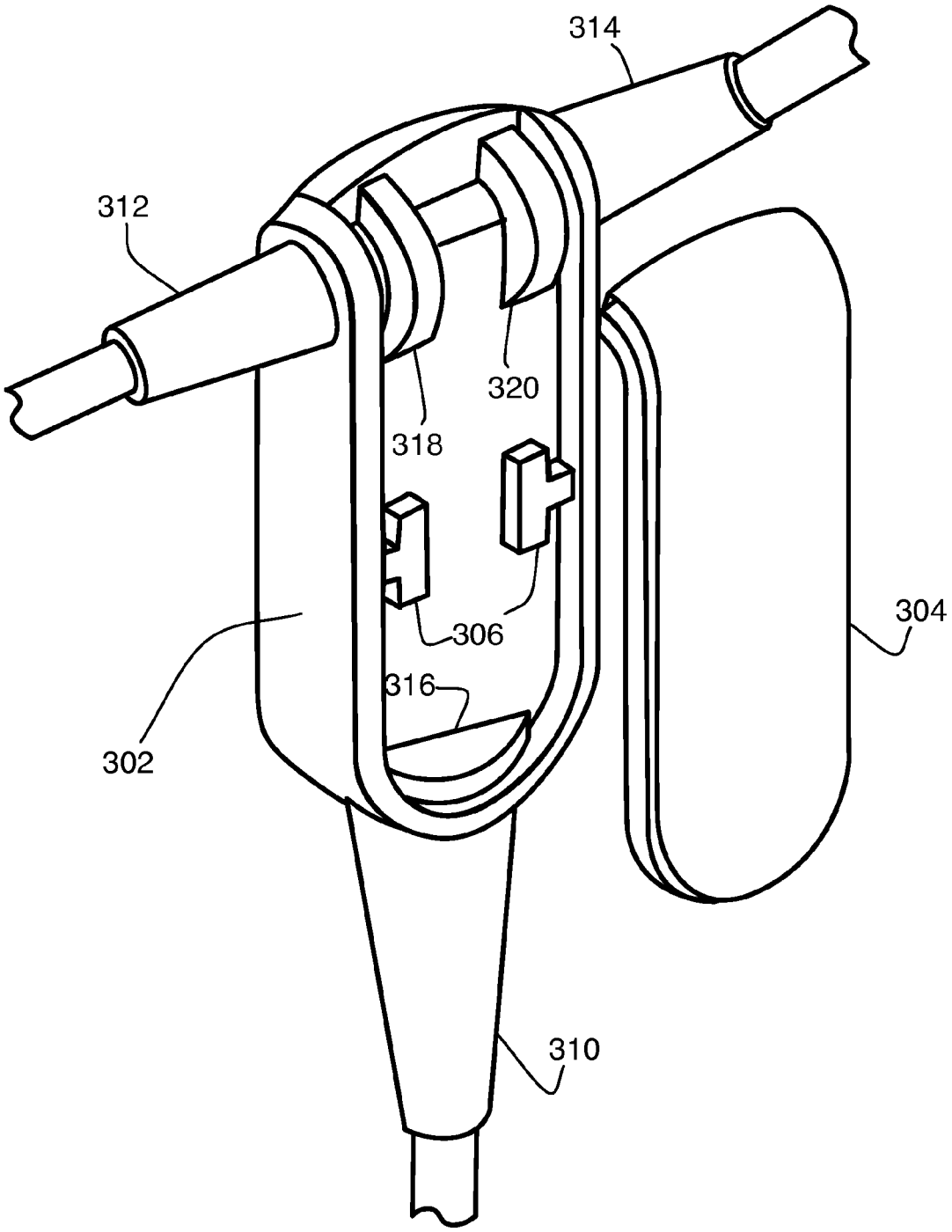
FIG. 3 shows an exploded view of one embodiment of the T-joint.
Figure 4A:
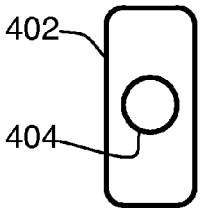
FIGS. 4A through 4E and 5A through 5E show orthogonal and perspective views of wiring stoppers for use in the T-joint.
Figure 4B:
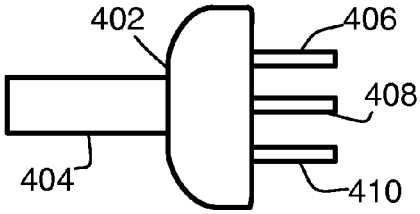
Figure 4C:
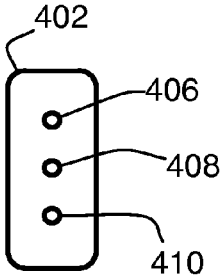
Figure 4D:
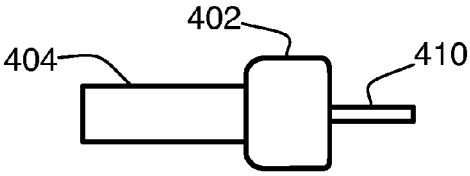
Figure 4E:
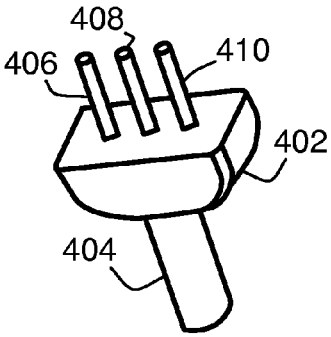
Figure 5A:
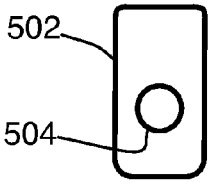
Figure 5B:
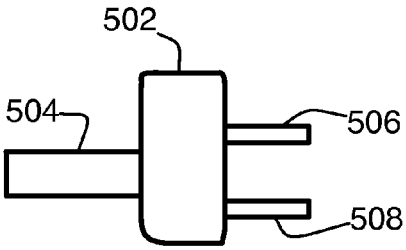
Figure 5C:
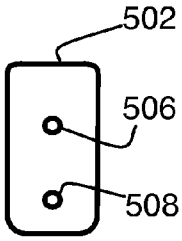
Figure 5D:
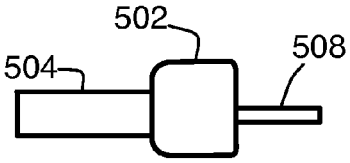
Figure 5E:
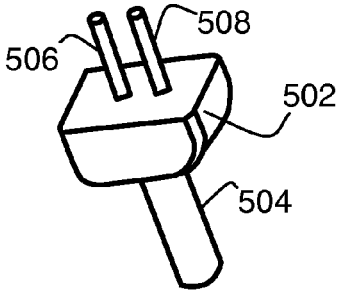

FIG. 3 shows one implementation of the T-joint. In this implementation, the joint body includes an outer shell 302, and a top cover 304. In some examples, not shown, there may also be a matching bottom cover. The shell 302 includes mounting features 306 for attaching a printed circuit board, or PCB, described below. Strain relief plugs 310, 312, and 314 are inserted into holes in the shell 302, leaving a large flange 316, 319, 320 inside the joint body to anchor both the strain reliefs and the respective cables. The strain relief plugs may be of the type described in U.S. Patent publication 2014/0270221, incorporated here by reference, in which the strain relief plug is molded in place around the cable, and then the cable and plug and pulled through the hole in the body until the external part of the plug protrudes from the body. Such plugs also provide waterproofing.

FIGS. 4A-4E and 5A-5E show an alternative design for anchoring the cables, in which an internal plug body 402, 502 is formed at the end of the cable jacket 404, 504. Conductors (wires or pins) 406, 408, 410, 506, 508 protrude from the plug. The plug body serves to anchor the cable inside the joint body, with the strain relief provided in a similar manner to that shown in FIG. 3, or over-molded as shown below, or in other conventional ways. The cable plugs may be inserted into a joint body having holes for the cable jackets (and possibly strain reliefs), or the joint body may be assembled from two halves that close around the cable plugs. As shown, FIGS. 4A-4E show a symmetric plug for use retaining the lower cable 202 to the bottom of the T-joint body, and FIGS. 5A-5E show an asymmetric plug for use retaining each of the upper cables 204 and 206 at the top corners of the T-joint body. In some examples, the right and left upper plugs will not be identical (or mirror images), as one may have more conductors than the other. The conductors protruding from the plug bodies may be wires, for soldering to subsequent components, or may be pins, for inserting into sockets inside the T-joint body.

Figure 6A:
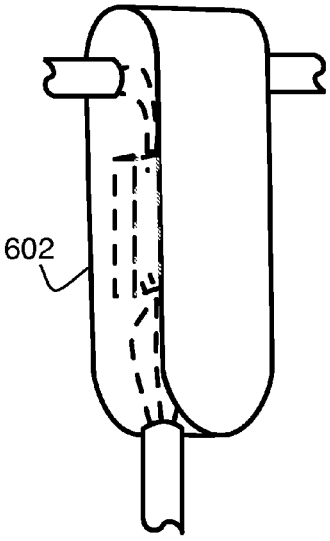
FIGS. 6A, 6B, and 6C show components of another embodiment of the T-joint.
Figure 6B:
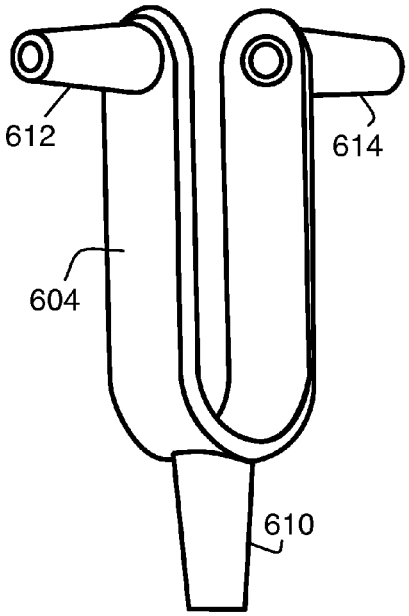
Figure 6C:
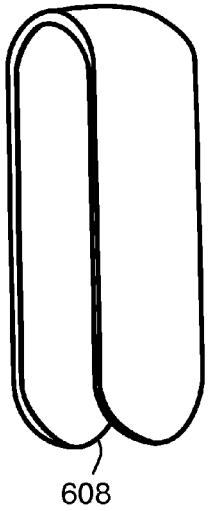
Figure 6D:
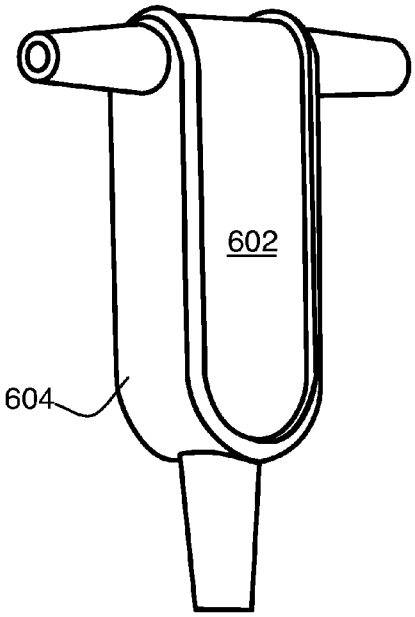
FIG. 6D shows a perspective view of the parts shown in FIGS. 6A and 6B as assembled.
Figure 6E:
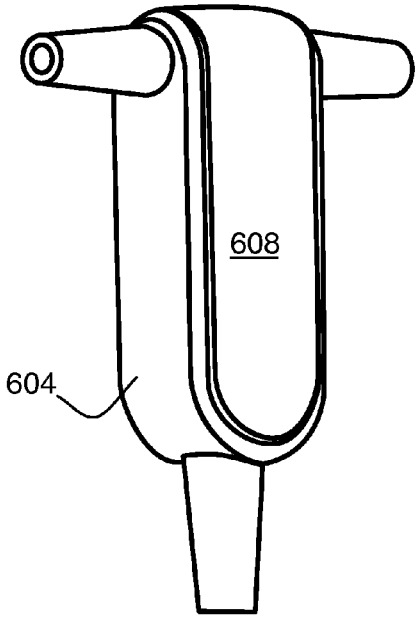
FIG. 6E shows a perspective view of the completed T-joint of FIG. 6D.

FIGS. 6A through 6E show another implementation of the T-joint. FIG. 6A shows an electronics body 602 in which the wires are connected, such as by the PCB mentioned above and described blow, or directly soldered together. An over-mold 604, shown in FIG. 6B, is then molded in place around the electronics body 602, as shown in FIG. 6D. The over-mold provides all three strain reliefs 610, 612, and 614, as well as a soft-touch rubber covering around the sides and bottom of the joint. Optionally, an additional cover 608, shown in FIG. 6C, is placed over the front, back, and top of the electronics body. This may provide cosmetic and tactile differentiation from the over-mold, and can also provide access to the electronics body, if the over-mold is masked or cut away on the front and back faces, for testing or service.

As mentioned above, the cables may be joined together inside the joint body using a printed circuit board, or PCB.

Figure 7:
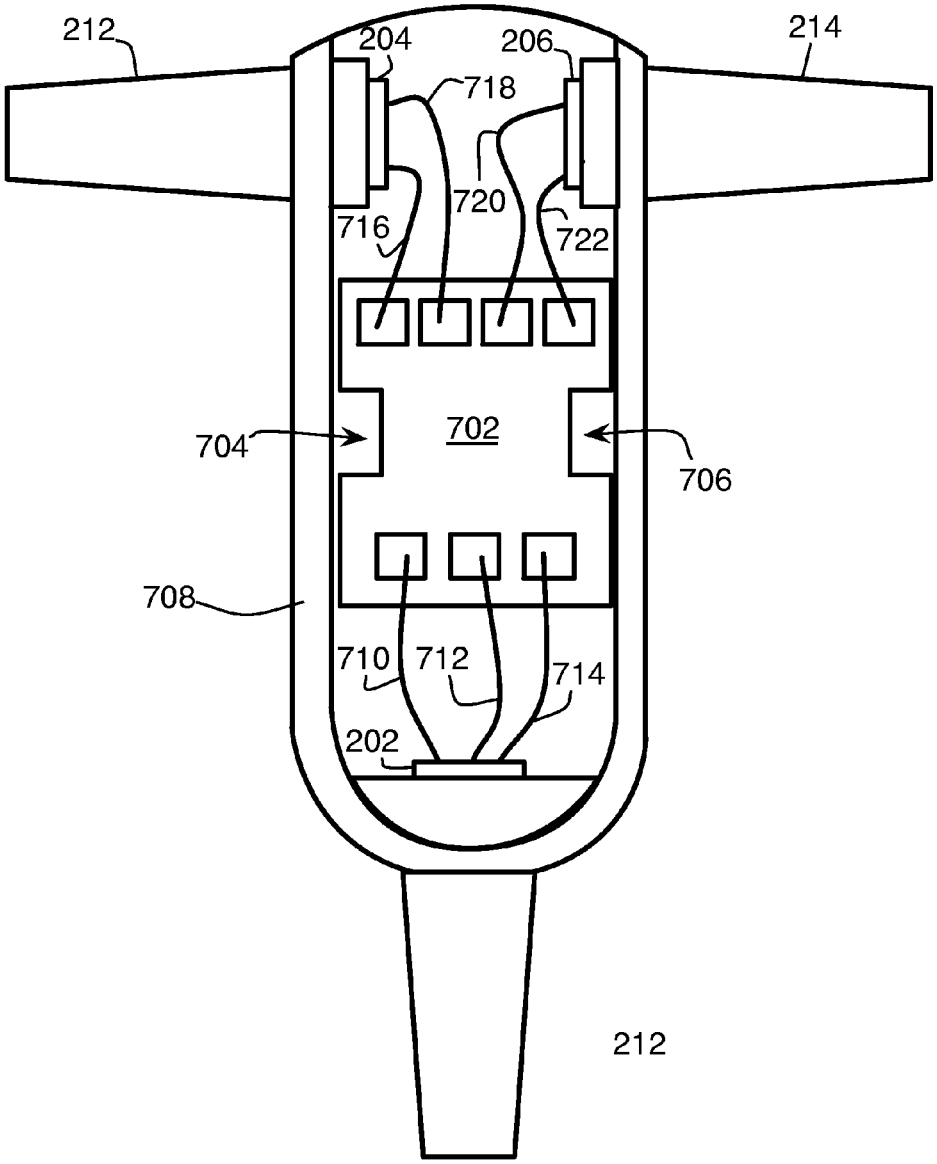
FIG. 7 shows a cut-away plan view and wiring of one embodiment of the T-joint.

This example is shown in FIG. 7. In this example, a PCB 702 has two cut-outs 704, 706 corresponding to the mounting features 306 from FIG. 3. The PCB is snapped, press-fit, or glued to the joint body 708, and then the conductors are each soldered to appropriate pads on the PCB. This wiring implementation can be used with either of the examples in FIG. 3 or 6 above. The PCB provides the connections between the right, left, and ground conductors 710, 712, 714 in the lower cable 202 and the corresponding signal and ground conductors 716, 718, 720, 722 in the right and left upper cables 204, 206. In some examples, additional conductors are present in at least the lower cable 202, such as microphone signal conductors and conductors for a user interface. Some or all of these conductors may also be present in one or both of the right and left cables, with connections made through the PCB. Alternatively, the microphone or user interface may be located in the joint assembly, i.e., on the PCB. In some examples, each distinct audio signal—left, right, and microphone—has its own ground, so there are multiple ground conductors present in the lower cable 202. The example showing only left and right audio conductors and a common ground is for illustration only.

In some examples, as mentioned above, one or more microphones is included in the T-joint. The microphones may be on the same PCB shown for electrically connecting the cables to each other, or they could be separate from that PCB. As mentioned, the T-joint maintains a more consistent position on the body than a Y-joint, so multiple microphones can be used to form a beam-forming array aimed at the user's mouth, or away from the user to detect a conversation partner. The aiming of such an array will be more reliable given the more consistent positioning of the T-joint.

Figure 8:
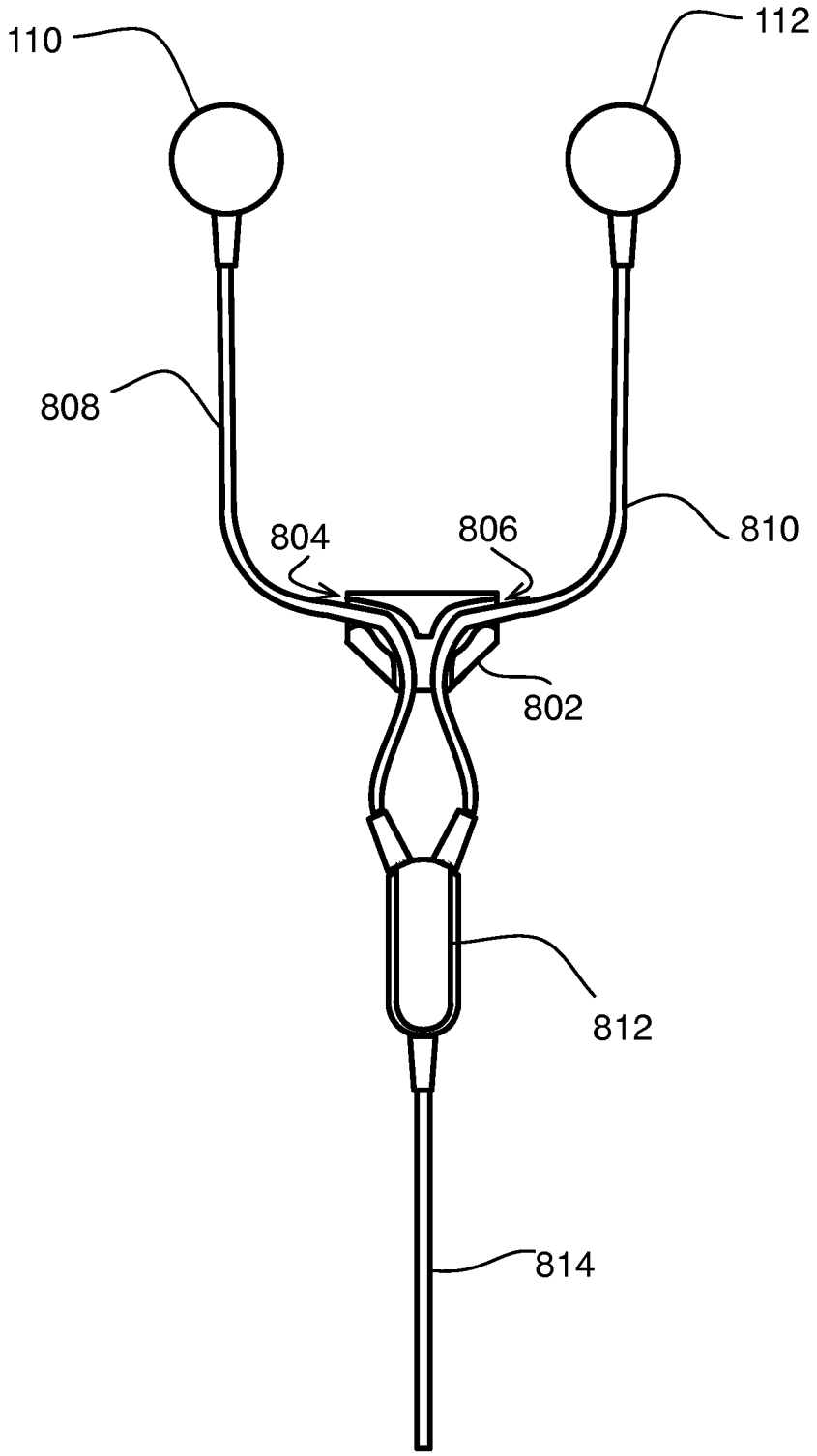
FIG. 8 shows an alternative mechanism for positioning cables in a headphone.

FIG. 8 shows an alternative mechanism for positioning the cables from a conventional Y-joint, or any other generally parallel cables, to achieve the benefits of the T-joint described above. As shown, a cable management slider 802 has a pair of channels 804, 806, though which the cables 808, 810 pass. The cables are free to slide within the channels, but the shape of the slider 802 assures that the upper portions of the cables exit the slider in opposite directions and far-enough apart to achieve the four-bar linkage effect of the T-joint. The lower portions of the cables enter the slider 802 from below, so that the weight of the lower portions and whatever they are attached to (a conventional Y-joint 812 and common cable 814, for example) hangs down from the T-joint formed by the slider 802. The slider may be open on one side, optionally with an attachable cover, so that it can be added to any set of cables, or it may be permanently assembled to a pair of cables as part of the headphone manufacturing process.

A number of implementations have been described. Nevertheless, it will be understood that additional modifications may be made without departing from the scope of the inventive concepts described herein, and, accordingly, other embodiments are within the scope of the following claims.

What is claimed is:

1. An apparatus comprising:

first and second electroacoustic output transducers;

first and second cables each including conductors electrically coupled to inputs of the corresponding first and second electroacoustic output transducers;

a third cable including conductors;

a joint housing, wherein the conductors of the third cable are electrically coupled to corresponding conductors of the first and second cables inside the joint housing;

each of the first, second, and third cables is physically retained to the joint housing; and the first and second cables exit the joint housing at a distance of at least 10 mm apart from each other; and first and second strain reliefs surrounding the respective first and second cables where the cables enter the joint housing, wherein the first and second cables exit the joint housing in first and second directions opposite to each other; and the first and second strain reliefs maintain the first and second cables in the respective first and second directions for a distance of at least 5 mm from a centerline of the joint housing.

2. The apparatus of claim 1 wherein:

the third cable exits the joint housing in a third direction; and the first and second cables exit the joint housing in the first and second directions opposite to each other, each perpendicular to the direction of the third cable.

3. The apparatus of claim 1 wherein the first and second strain reliefs mechanically retain the first and second cables to the joint housing.

4. The apparatus of claim 1 wherein the joint housing comprises:

an inner assembly within which the conductors of the first, second, and third cables are electrically coupled, and an over-mold covering at least the portions of the inner assembly where the first, second, and third cables exit the joint housing, the over-mold extending away from the inner assembly to also form strain reliefs around each of the first, second, and third cables.

5. The apparatus of claim 4, wherein the joint housing further comprises an outer cover covering portions of the inner assembly other than where the first, second, and third cables exit the joint housing.

6. The apparatus of claim 5, wherein the over-mold covers the entirely of the inner assembly, and the outer cover covers a portion of the over-mold.

7. The apparatus of claim 5, wherein the over-mold does not cover portions of the inner assembly covered by the outer cover.

8. The apparatus of claim 1, wherein the joint housing comprises:

an inner shell within which the conductors of the first, second, and third cables are electrically coupled, and to which the cables are retained, and having an open portion through which the conductors are accessed, and an outer cover covering the open portion of the inner shell.

9. The apparatus of claim 8, wherein the first, second, and third cables are retained in the inner shell by first, second, and third plugs affixed to ends of outer jackets of the respective cables, the plugs being larger than openings in the inner shell through which the cables pass.

10. The apparatus of claim 1, wherein:

the third cable further comprises additional conductors electrically coupled to components within the joint housing.

11. An apparatus comprising:

first and second electroacoustic output transducers;

first and second cables each including conductors electrically coupled to inputs of the corresponding first and second electroacoustic output transducers;

a third cable including conductors;

a printed circuit board; and a joint housing, wherein the conductors of the first, second, and third cables are each electrically coupled to the printed circuit board, and are electrically connected to each other by circuitry within the printed circuit board, the conductors of the third cable are electrically coupled to corresponding conductors of the first and second cables inside the joint housing, each of the first, second, and third cables is physically retained to the joint housing, the first and second cables exit the joint housing at a distance of at least 10 mm apart from each other, the third cable further comprises additional conductors electrically coupled to the printed circuit board, and the joint housing further comprises additional components coupled to the additional conductors of the third cable via the printed circuit board.

12. The apparatus of claim 11, wherein the additional components comprise a microphone array.

13. The apparatus of claim 11, wherein the additional components comprise buttons.

14. An apparatus comprising:

a connector having electrical contacts for receiving two electrical signals;

first and second electroacoustic output transducers;

first and second cables each including conductors electrically coupled to inputs of the corresponding first and second electroacoustic output transducers;

a third cable including conductors electrically coupled to the contacts in the connector; and a joint housing;

wherein the conductors of the third cable are electrically coupled to corresponding conductors of the first and second cables inside the joint housing;

each of the first, second, and third cables is physically retained to the joint housing; and the third cable exits the joint housing in a first direction; and the first and second cables exit the joint housing in second and third directions opposite to each other, each perpendicular to the direction of the third cable; and first and second strain reliefs surrounding the respective first and second cables where the cables enter the joint housing, wherein the first and second strain reliefs maintain the first and second cables in the respective second and third directions for a distance of at least 5 mm from a centerline of the joint housing.

15. The apparatus of claim 14 wherein the first and second strain reliefs mechanically retain the first and second cables to the joint housing.

16. The apparatus of claim 14 wherein the joint housing comprises:

an inner assembly within which the conductors of the first, second, and third cables are electrically coupled, and an over-mold covering at least the portions of the inner assembly where the first, second, and third cables exit the joint housing, the over-mold extending away from the inner assembly to also form strain reliefs around each of the first, second, and third cables.

* * * * *